US005630334A

United States Patent [19]

Ash

[11] Patent Number: 5,630,334

[45] Date of Patent: May 20, 1997

[54] LIQUID IMPACT TOOL FORMING MOLD

[75] Inventor: Stanley P. Ash, Greenville, Mich.

[73] Assignee: Greenville Tool & Die Company, Greenville, Mich.

[21] Appl. No.: 550,711

[22] Filed: Oct. 31, 1995

[51] Int. Cl.[6] ..... B21D 9/15

[52] U.S. Cl. ..... 72/61; 72/58

[58] Field of Search ..... 72/58, 61, 62

[56] References Cited

U.S. PATENT DOCUMENTS

| | | | |
|---|---|---|---|
| 203,842 | 5/1878 | Leland . | |
| 567,518 | 9/1896 | Simmons . | |
| 3,105,537 | 10/1963 | Foster . | |
| 3,739,615 | 6/1973 | Tressel . | |
| 4,744,237 | 5/1988 | Cudini . | |
| 4,829,803 | 5/1989 | Cudini . | |
| 5,070,717 | 12/1991 | Boyd et al. . | |
| 5,339,667 | 8/1994 | Shah et al. . | |
| 5,353,618 | 10/1994 | Roper et al. . | |
| 5,363,544 | 11/1994 | Wells et al. | 72/58 |
| 5,415,021 | 5/1995 | Folmer . | |
| 5,481,892 | 1/1996 | Roper et al. | 72/61 |
| 5,485,737 | 1/1996 | Dickerson | 72/58 |

OTHER PUBLICATIONS

Sanjay Shah et al., *Tube Hydroforming: Process Capability and Production Applications,* Body Assembly & Manufacturing Proceedings, Internal Body Engineering Conference (Sep. 1994).

William L. Christensen, *Hydroforming of Tubular Sections,* MetalForming (Oct. 1995).

*Primary Examiner*—David Jones

*Attorney, Agent, or Firm*—Warner Norcross & Judd LLP

[57] ABSTRACT

A metal tube is cold formed into a stamped member by tube is cold formed into a stamped member by sealing a tube containing liquid at approximately atmospheric pressure and then stamping the liquid-filled tube in a die. The pressure within the tube increases during the stamping step to force the walls of the tube to conform to the die cavity, eliminating the need to pressurize the tube prior or subsequent to stamping.

20 Claims, 3 Drawing Sheets

LIQUID IMPACT TOOL FORMING MOLD

BACKGROUND OF THE INVENTION

The present invention relates to cold forming tubular materials, and more particularly to forming structural members using liquid-filled metal tubes.

Tube hydroforming is a known method of cold forming metal tubes to create structural members, for example, for the automotive industry. In a typical hydroforming process, a tube is partially deformed by stamping it in a die. Then, internal hydraulic pressure exceeding the yield strength of the tube wall is applied to force the tube to expand and to conform to the die cavity—much like blowing up a balloon. Several references discuss hydroforming methods. These references include U.S. Pat. No. 5,339,667 issued Aug. 23, 1994 to Shah et al., entitled "Method for Pinch Free Tube Forming"; U.S. Pat. No. 5,070,717 issued Dec. 10, 1991 to Boyd et al., entitled "Method of Forming a Tubular Member with Flange"; and U.S. Pat. No. 4,744,237 issued May 17, 1988 to Cudini, entitled "Method of Forming Box-Like Frame Members"; and Sanjay Shah et al., *Tube Hydroforming: Process Capability and Production Applications*, Body Assembly & Manufacturing Proceedings, International Body Engineering Conference (Sept. 1994).

Hydroforming processes offer several advantages over conventional die-stamping processes for cold forming metal tubes. These advantages include reduced variation in the finished pieces, reduced number of steps needed to produce the finished pieces, improved structural integrity of the finished pieces, and eliminated need to join separately pressed parts by welding. However, hydroforming has the disadvantage of requiring expensive and specialized die machinery to handle the extreme pressures to which the tube must be exposed. In particular, hydroforming requires additional machinery external to the die, such as pumps and intensifiers, to boost the internal hydraulic pressure of the tube. Further, the high pressures required for hydroforming can be dangerous to machine operators.

Several variations of the hydroforming process exist. For example, U.S. Pat. No. 4,829,803 issued May 16, 1989 to Cudini, entitled "Method of Forming Box-Like Frame Members" discloses a step of hydraulically pressurizing the internal space of a tube prior to closing the die, to allow better control of the deformation of the tube wall during die closure. The pressure to which the tube is initially pressurized, typically about 300 p.s.i.g., is selected to be less than the yield limit of the tube wall, but high enough so that during die closure (i.e., stamping), as the upper and lower die sections compress the tube, the tube walls are forced evenly toward the corners of the die cavity. More specifically, as the die closes, the hydraulic pressure within the tube causes the tube wall to overcome the frictional forces tending to resist the tube wall's transverse slippage over the surface of the upper and lower die sections. Thus, the internal pressure is selected so that the tube wall slides over the surface of the die sections and avoids being pinched between the upper and lower die sections as they mate.

To assure that the internal tube pressure during the '803 process does not rise to cause yielding of the tube wall during die stamping, a pressure relief valve is positioned in one end of the tube, set to release the liquid at a pressure below the yield limit of the tube. However, since the tube wall at the completion of this stamping process is bowed or dished inwardly, the '803 process requires a final hydroforming step of applying internal pressure to exceed the yield limit of the tube wall, and to expand the tube to conform to the die cavity. Thus, the '803 process does not escape the disadvantages of the hydroforming process. Rather, the '803 process adds an initial pressurization step to the hydroforming process, thereby slowing the tube forming process and increasing the cost of hydroforming.

Another variant of the tube hydroforming process is described in U.S. Pat. No. 5,353,618 issued Oct. 11, 1994 to Roper et al., entitled "Apparatus and Method for Forming a Tubular Frame Member," which discloses hydraulically pressurizing the interior of a tube to just below its burst pressure (yield strength) prior to bending and die stamping the tube, in order to ensure uniform, non-buckling deformation of the tube. A pressure relief valve and a hydraulic pressure source act in concert to maintain the internal pressure within the tube at just below the tube's burst pressure during the bending and stamping steps.

In utilizing the '618 process, if the cross-sectional perimeter of the preformed tube is, in some areas of the tube, less than the cross-sectional perimeter of the die cavity, then the tube must be expanded into the small radiused corners of the die cavity by subsequent hydroforming. However, if the cross-sectional perimeter of the die cavity is approximately equal to the cross-sectional perimeter of the preformed tube, then the tube will conform to the die cavity without subsequent hydroforming if the internal tube pressure prior to die stamping is near, yet less than, the internal burst pressure of the tube. (See Col. 18, lns. 7–33.)

The '618 process has several disadvantages. The requirement that the tube be internally pressurized prior to die stamping adds a step that increases the complexity of the tube forming process, and increases the amount of equipment needed to complete the process. Further, subjecting the tube to high pressures prior to stamping requires a step that slows the forming process and therefore increases the cost of tube forming. Also, pressurizing a tube prior to stamping it decreases the safety of the stamping operation. A final disadvantage of the '618 process is the limitation that the internal pressure of the tube during the die stamping step remain below the yield strength (i.e., burst pressure) of the tube wall. This limitation ultimately requires an additional hydroforming step to expand the tube if the cross-sectional perimeter of the die cavity is greater than the preformed tube circumference.

It is known in the unrelated field of pipe bending that increasing the internal hydrostatic pressure of a pipe can help to prevent buckling or wrinkling of the pipe wall when bending the pipe. See, for example, U.S. Pat. Nos. 3,105,537 issued Oct. 1, 1963 to Foster, entitled "Bending Pipe"; U.S. Pat. No. 567,518 issued Sep. 8, 1896 to Simmons, entitled "Mechanism for Bending Pipe"; and U.S. Pat. No. 203,842 issued May 21, 1878 to Leland, entitled "Method of Bending Plumbers' Traps." The elevated hydrostatic pressures, although lower than hydroforming pressures, suffer the same disadvantages noted above. Further, the express purpose of pipe bending is to maintain the same cross-sectional roundness following bending.

SUMMARY OF THE INVENTION

The aforementioned problems are overcome in the present invention wherein a metal tube is filled with liquid at approximately atmospheric pressure and then is die stamped using a conventional die to cold form the tube to a non-cylindrical shape. More specifically, the process includes the following steps: First, a metal tube is filled with a liquid, such as water, at a pressure that is approximately atmospheric. Second, the ends of the liquid-filled tube are sealed to confine the liquid within the tube at this approximately atmospheric pressure. Third, the liquid-filled sealed tube is stamped in a conventional die to form the tube into a desired configuration, such as a box-shaped structural member. Liquid may be released during the stamping step. Finally, the remaining liquid is drained from the formed, stamped member.

In an extended aspect of the present invention, the liquid-filled sealed tube is stamped in a die to form a stamped member whose circumferential configuration varies longitudinally; that is, one portion of the tube has its cross-sectional area contracted or restricted during die stamping, while another portion of the tube expands to conform to a cross-sectional perimeter of the die cavity that is larger than the circumference of the preformed tube.

The present invention eliminates the need to elevate the internal pressure of the tube prior to die stamping the tube. Further, the invention does not require hydroforming; that is, it does not require an additional step of elevating the internal pressure of the tube after die stamping in order to conform the walls of the stamped tube to the walls of the die cavity. Thus, the method of the present invention permits cold forming a tube with a minimal number of process steps, while retaining the previously discussed advantages of hydroforming, and avoiding the previously discussed disadvantages of a pre-forming pressurization step or a post-stamping hydroforming step. Further, the method of the present invention allows an extremely fast production rate of cold-formed metal tubes. Lastly, the method of the present invention does not require a specialized die or press—the method can be used with standard mechanical or hydraulic dies or presses that have a sufficient size and tonnage capacity.

These and other objects, advantages, and features of the invention will be more readily understood and appreciated by reference to the detailed description of the preferred embodiment and the drawings.

DETAILED DESCRIPTION OF THE PREFERRED EMBODIMENT

I. Die Stamping an Empty Tube (Prior Art)

Figure 1:
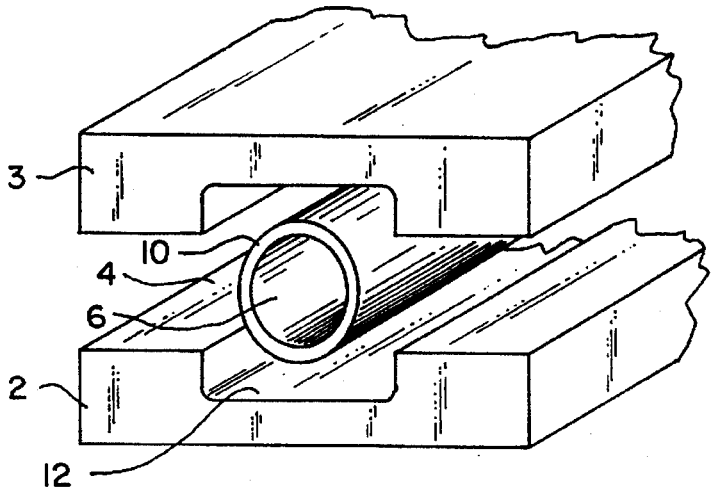
FIG. 1 (PRIOR ART)
FIG. 1 is a perspective view of a conventional die in an open position.

FIG. 1 shows a perspective view of a conventional die with lower and upper die sections 2 and 3. Tube 4 is placed between lower and upper die sections 2 and 3 prior to stamping or mating of the dies. Tube 4 does not contain any liquid in the tube interior 6.

Figure 2:
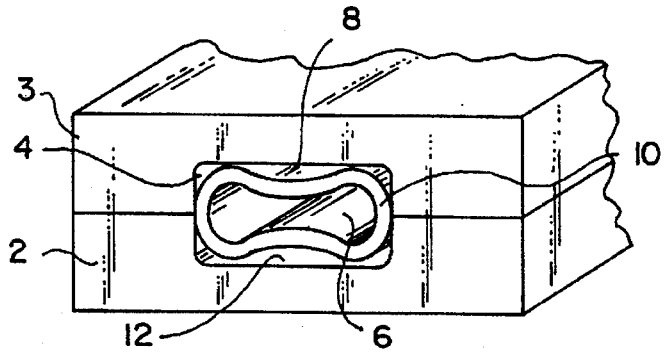
FIG. 2 (PRIOR ART)
FIG. 2 is a perspective view of the die of FIG. 1 in a closed position.

FIG. 2 shows the configuration of tube 4 once lower and upper die sections 2 and 3 are mated and tube 4 is stamped. Rather than conforming to the die cavity 8 formed by the mating of die sections 2 and 3, the tube wall 10 collapses and fails to conform to the shape of the interior walls 12 of die sections 2. Typically, then, after die stamping tube 4, a conventional hydroforming process is used, in which the pressure within tube interior 6 is increased beyond the yield strength of the material of tube 4, and tube 4 is forced to conform to the die cavity 8.

II. Present Invention

Figure 3:
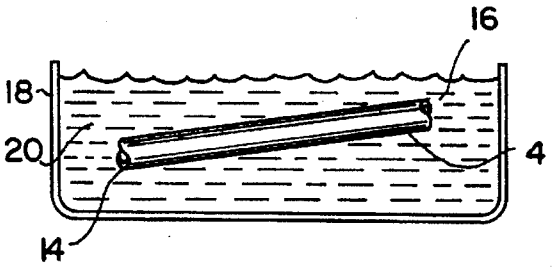
FIG. 3 is a side view of a tube submerged in liquid.

In the present invention, a tube is filled with a liquid at approximately atmospheric pressure prior to stamping the tube in a die. One inexpensive and readily available liquid is water. If desired, additives such as lubricants, bactericides, or rust preventatives can be added to the liquid, as is known in the art. FIG. 3 shows the preferred method for filling a tube with liquid. Tube 4 has open ends 14 and 16, and a given interior volume (not shown). Tube 4 is submerged in a tub or basin 18 containing liquid 20. Open end 16 is elevated relative to open end 14, so that, as the air that is in the interior volume of the tube exits through elevated open end 16, the interior volume of tube 4 fills with liquid 20 entering through open end 14.

Figure 4:
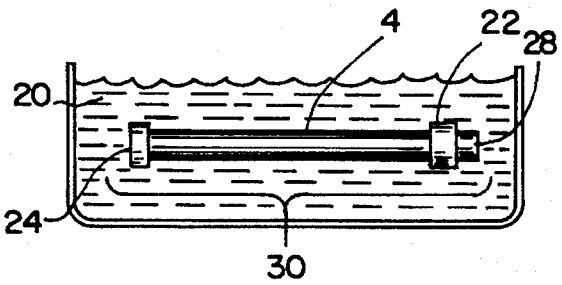
FIG. 4 is a side view of a liquid-filled sealed tube submerged in liquid.

Referring to FIG. 4, once tube 4 is filled with liquid, the tube is sealed. A preferred method of sealing tube 4 is by attaching caps 22 and 24 to the ends of tube 4 while the tube remains submerged, thus enclosing liquid 20 within tube 4. The caps must be attached to form a seal that can withstand the elevated pressures to which the tube will be subjected later in the process.

Figure 4A:
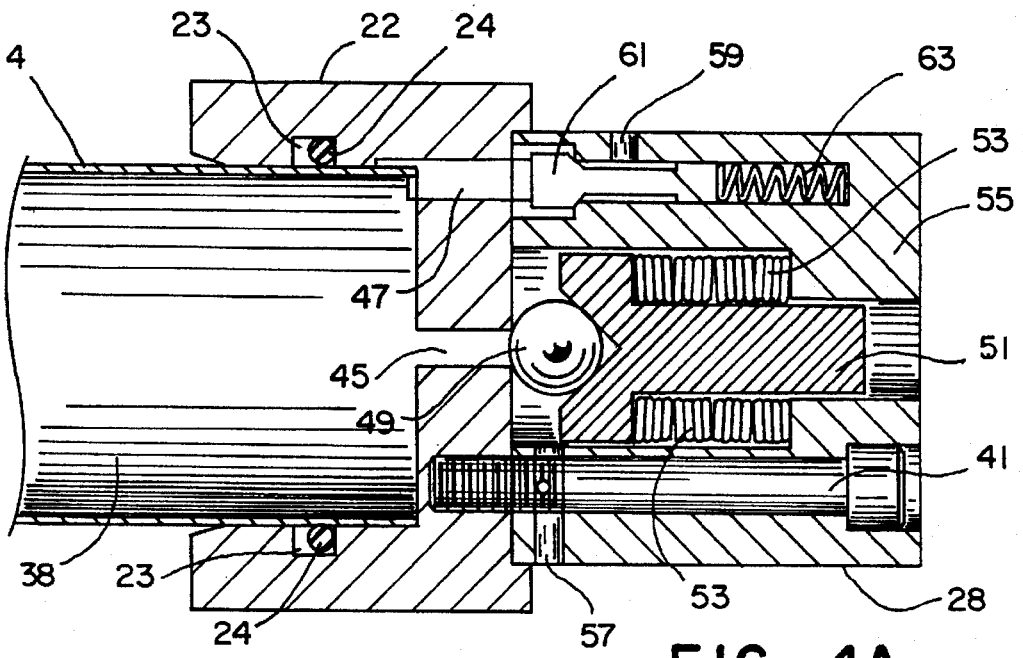
FIG. 4*a* is a side, cross-sectional view of the cap and relief valve of FIG. 4.

Methods of attaching a cap to the end of a tube to form a pressure-tight seal are known in the art. One method of attaching the caps is to weld the caps to the tube. A preferred method of attaching the caps is shown in FIG. 4*a*. Cap 22, which has an interior groove 23, encloses one end of tube 4. O-ring 24 is positioned within interior groove 23, preferably with some preload stress upon it, as is known in the art. O-ring 24 forms a seal between cap 22 and tube 4 to prevent the liquid within the interior of tube 4 from escaping during subsequent processing. Preferrably, O-ring 24 is 3/16 inch in diameter, and is made of a hard rubber, for example 90-durometer nitrile rubber. Preferably, "backups" or nylon washers (not shown) are used in conjunction with O-ring 24, as is known in the art.

While using caps to seal tube 4 is the preferred sealing method, other methods known in the art for sealing tubes can be used. For example, the ends of the tube can be pinched and welded shut.

Referring again to FIG. 4, relief valve 28 is attached to cap 22. After attachment of caps 22 and 24 to tube 4 and closure of relief valve 28, the interior of tube 4 is completely sealed or enclosed to form sealed tube 30, which is full of liquid 20 at approximately atmospheric pressure.

Figure 5:
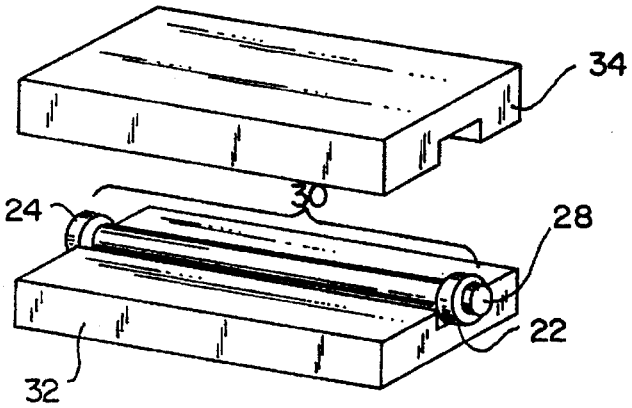
FIG. 5 is a perspective view of a liquid-filled sealed tube placed in an open die.

Referring to FIG. 5, sealed tube 30, which has an interior volume filled with liquid at approximately atmospheric pressure, is shown positioned in lower die section 32 prior to the closure or mating of upper die section 34 with lower die section 32. While FIG. 5 shows a die that has an upper and a lower die section, the method of the present invention can be used with a die that contains more than two die sections, for example a die that also contains sidewall die sections, or with die sections that close horizontally rather than vertically. Gas springs (not shown) can be built into the die mold along with cam steels (not shown) to give added control during the cold forming process.

Figure 6:
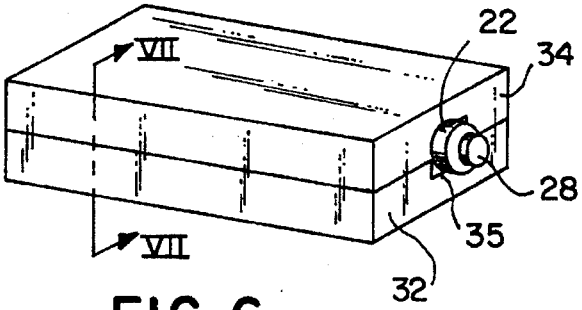
FIG. 6 is a perspective view of the die of FIG. 5 in a closed position.

FIG. 6 shows lower die section 32 and upper die section 34 in a closed or mated position, resulting in the die stamping of the liquid-filled sealed tube to form stamped member 35, which has a given exterior configuration and a given interior volume (not shown). The die stamping of the tube, that is, the stamping operation, can occur in one stamping step, or may require multiple stamping steps to completely form stamped member 35. Preferably, cap 24 (not shown) and pressure relief valve 28 (and thus indirectly cap 22) are "backed up" or held in place by die sections (not shown), to prevent caps 22 and 24 from moving or sliding off the end of the tube when the pressure within the tube increases during the stamping operation.

Figure 7:
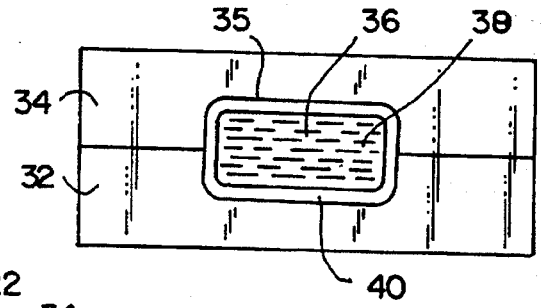
FIG. 7 is a sectional view taken along line VII—VII in FIG. 6.

FIG. 7 shows a cross section of the closed die of FIG. 6. Die sections 32 and 34 are mated to form die cavity 36, which has a given interior configuration. While preferably the sealed tube (not shown) has a circumference that is approximately equal to the circumference of the die cavity 36, the circumference of the sealed tube (not shown) prior to stamping could be as little as about 70 percent of the circumference of the die cavity 36 (i.e., the cross-sectional perimeter of the interior of the die cavity 36 formed by the mating of lower die section 32 and upper die section 34).

Figure 8:
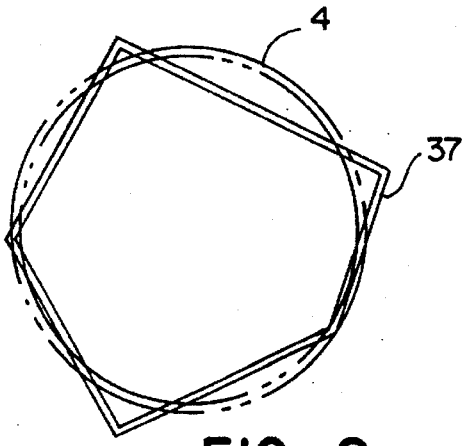
FIG. 8 is an end, cross-sectional view of a tube formed from an alternative die cavity configuration, juxtaposed with a cross-sectional view of a preformed tube.

While the die cavity 36 of FIG. 7 is shown having a rectangular cross-sectional shape—and thus a box-shaped interior configuration—the die cavity could have other non-cylindrical or polygonal cross-sectional shapes to form other die cavity interior configurations. For example, FIG. 8 shows a cross-sectional view of stamped member 37, which has been stamped in a die cavity having a five-sided polygonal cross-sectional shape, juxtaposed with the cross-section of tube 4. While tube 4 is shown having a cylindrical shape or exterior configuration prior to stamping, typically tubes provided for stamping have a cross-section in the shape of a multi-sided polygon that approaches a circular shape, 2B rather than an actual circular cross-sectional shape.

Figure 9:
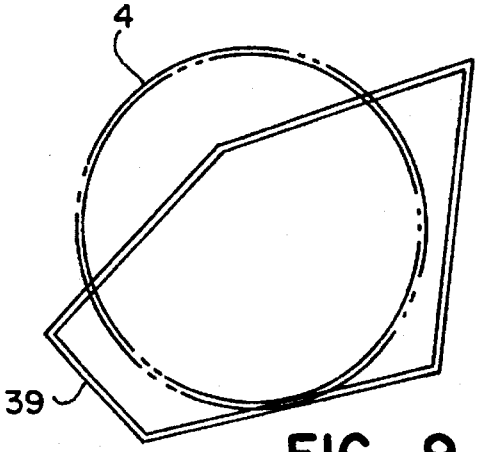
FIG. 9 is an end, cross-sectional view of a tube formed from another alternative die cavity configuration, juxtaposed with a cross-sectional View of a preformed tube.

In another example, FIG. 9 shows a cross-sectional view of stamped member 39, which has been stamped in a die cavity having an alternative five-sided polygonal cross-sectional shape. Stamped member 39 is also shown juxtaposed with a cross-section of tube 4.

Returning to FIG. 7, the compressive forces generated as the die closes to form stamped member 35 also act to compress the liquid 38 within the interior of the sealed tube as it changes shape. Thus, the pressure of the liquid 38 increases as the die closes. As the liquid resists compression, it forces the tube walls 40 outwardly toward the interior surface of the die cavity 36. Once die sections 32 and 34 have fully closed around the sealed tube, the tube walls 40 conform to the interior walls of the die cavity 36, and the exterior configuration of stamped member 35 conforms to the interior configuration of die cavity 36.

Because the interior volume of the sealed tube typically decreases as the die closes to stamp the tube into a non-cylindrically shaped stamped member 35, the volume of liquid 38 in excess of the interior volume of the final stamped member 35 must be released from the tube interior during the stamping process. This release is accomplished by use of pressure relief valve 28, shown in detail in FIG. 4*a*. The pressure relief valve 28 releases liquid from within the sealed tube as the pressure rises above the relief pressure setting during mating of the upper and lower die sections. The relief pressure setting is determined by trial and error; the optimum relief valve setting is the lowest one that allows the tube to expand into the die corners while stamping, so that minimal energy is needed to stamp the tube. For most configurations, the hydraulic pressure within the tube must rise to a pressure that causes the tube walls to exceed their yield strength. For a tube made of 1010 or 1020 ERW commercial steel, and having a 2-⅜ inch outer diameter and a 0.060 inch wall thickness, the pressure relief setting is 20,000 p.s.i.g.

Continuing with FIG. 4*a*, pressure relief valve 28 is attached directly to cap 22 by means of bolt 41. When cap 22 is used with pressure relief valve 28, cap 22 is constructed to define outlet port 45 and equalization port 47. Relief valve 28, shown in FIG. 4*a* in the closed position, has ball 49 resting against exit port 45, thus preventing the liquid 38 within tube 4 from passing through exit port 45. Positioner 51 holds ball 49 in place against outlet port 45. Springs 53 press against the interior of relief valve casing 55 and positioner 51, to force positioner 51 against ball 49. For the high relief-pressure settings required for the present invention (e.g., 20,000 p.s.i.g.) a series of spring washers works better than coil springs. The relief-pressure setting can be varied by adjusting the number and compression of the spring washers. Sixteen spring washers are sufficient for a relief-pressure setting of 20,000 p.s.i.g.

Relief valve casing 55 defines vent ports 57 and 59. The path between equalization port 47 and vent port 59 is blocked by piston 61, as shown in FIG. 4*a*, and thus piston 61 is in the closed position. When the pressure of liquid 38 is relatively low (i.e., near atmospheric pressure), spring 63 presses against piston 61 to hold piston 61 in the open position (not shown), so that liquid 38 can pass around piston 61 and through vent port 59. Thus, if cap 22 is attached to tube 4 while both are submerged in liquid, then the resistance against cap attachment caused by the compression of the liquid 38 within tube 4 can be eliminated. This facilitates the attachment of cap 22 to tube 4 when both are submerged in liquid. When the pressure of liquid 38 rises above atmospheric pressure to press against piston 61 and overcome the force of spring 63 holding piston 61 open, then piston 61 moves to close the path around it, sealing exit port 59.

When the pressures of liquid 38 rises to the point of forcing ball 49 to unseat from its position of blocking export 45 (i.e., the liquid reaches the relief-pressure setting), then liquid 38 flows through exit port 45 and passes through vent port 57. Thus, relief valve 28 controls the maximum pressure to which liquid 38 within tube 4 can rise, and allows excess liquid to vent through exit port 57.

While the present invention works with only one pressure relief valve (i.e., pressure relief valve 28 attached to cap 22), for safety reasons a back-up or reserve pressure relief valve (not shown), set to release pressure at a higher setting than relief valve 28, may also be used. The reserve pressure relief valve may be attached to the cap at the opposite end of the tube (i.e., cap 24), similar to the manner in which relief valve 28 is attached to cap 22.

Cold forming a non-lubricated tube using the method of the present invention requires that the pressure relief valve be set high enough so that the hydraulic pressure reaches a minimum level within the interior of the tube. Typically in a cold forming process, the exterior of a tube is lubricated to decrease the resistance of the tube walls to conforming to the interior walls of the die cavity. However, if the formed tube piece is to be used as a structural component of an automobile, manufacturer specifications usually permit only water-soluble lubricants to be used to lubricate the tube. Since in the present invention the tube is submerged in a liquid, typically water, any water-soluble lubricants are dissolved. Without tube lubrication, the relief pressure setting should preferably be set to allow the pressure within the sealed tube to rise to at least about 20,000 p.s.i.g. Otherwise, without tube lubrication, the walls of the sealed tube may not completely conform to the internal walls of the die cavity.

After die sections 32 and 34 have mated or closed to form stamped member 35, which has a non-cylindrical (e.g., polygonal cross-sectional) shape, the die is opened to release the stamped member 35. The caps are removed, and the remaining liquid is drained. If the caps or tube ends have been welded, the tube ends are sheared off. The tube ends are finished using methods that are known in the art.

Figure 10:
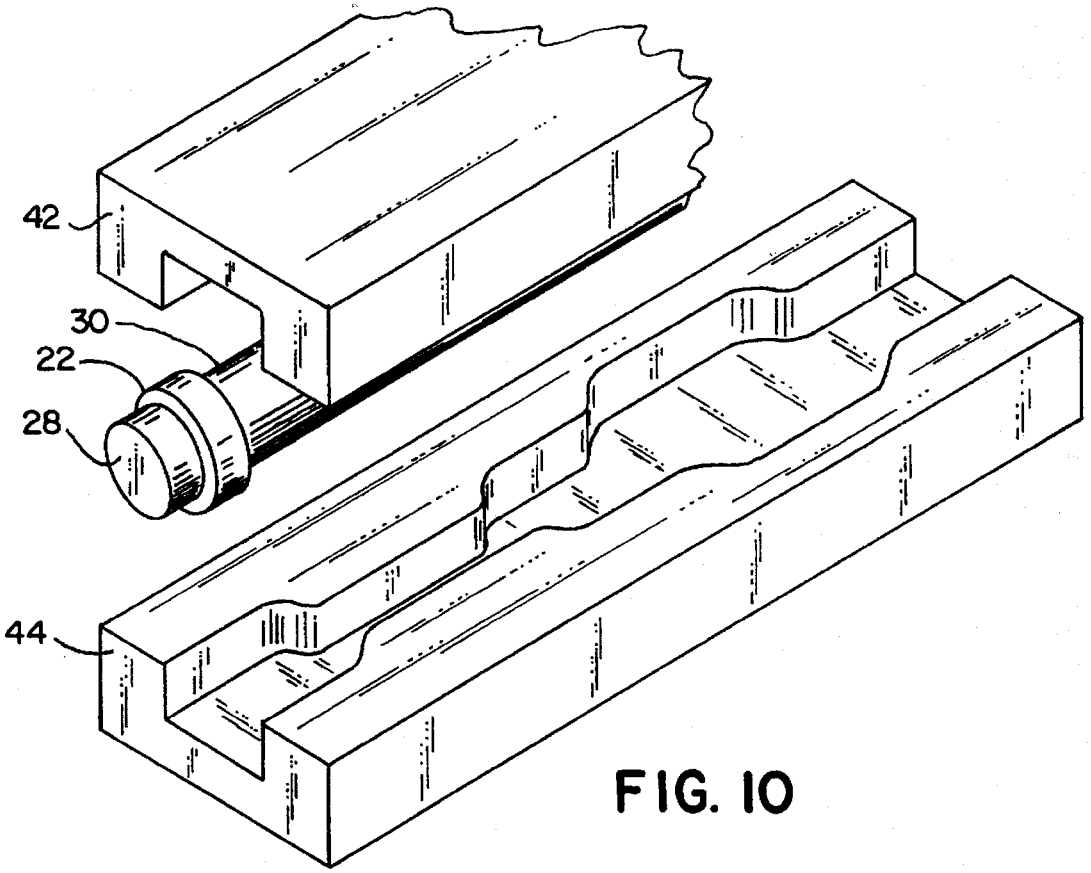
FIG. 10 is a perspective view of an alternative die in the open position showing an alternative die section configuration.

FIG. 10 shows an extended aspect of the present invention, in which the cross-sectional area of the die cavity, formed when upper die section 42 and lower die section 44 mate, varies along the length of the die cavity. When the die closes around liquid-filled sealed tube 30, some portions of the tube have their cross-sectional area contracted or restricted by the die sections during stamping. Other portions of the tube 30, which have a circumference smaller than the circumference of the die cavity, expand to conform to the interior die cavity wall. This expansion of the tube is caused by the pressure increase in the liquid generated when the upper and lower die sections 42 and 44 close to compress sealed tube 30. In some portions, the circumferential expansion of sealed tube 30 may be as high as about 30 to 40 percent of its original circumference, depending upon the wall thickness and material strength of tube 30. As with the previously discussed aspect of the present invention, the volume of liquid that exceeds the interior volume of the final stamped member is released from the interior of the tube during the stamping process through the use of pressure relief valve 28.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A process for cold forming a metal tube comprising the steps of:

filling a tube with a liquid;

sealing the tube with at least one cap having a pair of relief valves, one relief valve relieving liquid from the tube at approximately static pressure and the other relief valve relieving liquid from the tube at a stamping pressure substantially above static pressure, said sealing step forming a sealed tube having a given interior volume and confining the liquid within the sealed tube at approximately atmospheric pressure, the one relief valve permitting excess liquid to exit the tube during the sealing step;

stamping the sealed tube in a die having a die cavity of a given interior configuration to form a stamped member having an exterior configuration conforming to the interior configuration of the die cavity and having an interior volume no greater than the interior volume of the sealed tube;

releasing a volume of the liquid from within the sealed tube during the stamping operation approximately equal to the difference between the interior volume of the sealed tube and the interior volume of the stamped member, the other relief valve permitting the volume of liquid to exit the tube during the stamping step; and removing the cap and draining from within the stamped member the liquid remaining after the stamping step.

2. The process of claim 1 wherein the tube is sealed while the tube is submerged in liquid.

3. The process of claim 1 wherein the die hold the cap on the tube during the stamping step.

4. The process of claim 1 wherein the caps have O-ring seals.

5. The process of claim 1 wherein the other valve includes spring washers.

6. The process of claim 1 wherein the circumference of the stamped member is approximately equal to the circumference of the sealed tube.

7. The process of claim 1 wherein the circumference of the stamped member varies longitudinally.

8. The process of claim 7 wherein the circumference of the stamped member at a given point is greater than the circumference of the sealed tube.

9. The process of claim 8 wherein the circumference of the stamped member at a given point is less than the circumference of the sealed tube.

10. The process of claim 1 wherein the stamping step comprises a series of stamping operations.

11. A process for cold forming metal tubes comprising the steps of:

filling a tube with a liquid;

sealing the tube to form a sealed tube having a given interior volume and to confine the liquid within the sealed tube at approximately atmospheric pressure;

stamping the sealed tube in a die having a die cavity of a given interior configuration. to form a stamped member having an exterior configuration conforming to the interior configuration of the die cavity and having an interior volume no greater than the interior volume of the sealed tube;

releasing a volume of the liquid from within the sealed tube during the stamping operation approximately equal to the difference between the interior volume of the sealed tube and the interior volume of the stamped member through a pressure relief valve attached to a cap on the tube, wherein a die section holds the pressure relief valve on the cap; and draining from within the stamped member the liquid remaining after the stamping step.

12. A process for cold forming a metal tube comprising the steps of:

submerging a tube in liquid to fill the tube with the liquid;

sealing the tube while the tube is submerged in the liquid with a pair of caps on opposite ends of the tubes, at least one of the caps including a low-pressure valve for releasing the liquid at a relatively low pressure and a high-pressure valve for releasing the liquid at a relatively high pressure, the low-pressure valve permitting the liquid to exit the tube during the sealing step, the sealing step forming a sealed tube having a given interior volume and confining the liquid within the sealed tube at the relatively low pressure;

stamping the sealed tube in a die having a die cavity of a given interior configuration to form a stamped member having an exterior configuration conforming to the interior configuration of the die cavity and having an interior volume no greater than the interior volume of the sealed tube;

releasing as necessary a volume of the liquid from within the sealed tube through the high-pressure valve during the stamping step approximately equal to the difference between the interior volume of the sealed tube and the interior volume of the stamped member; and removing the caps and draining from within the stamped member the liquid remaining after the stamping step.

13. The process of claim 12 wherein die sections hold the caps on the tube during the stamping step.

14. The process of claim 13 wherein the die section holds the high-pressure valve on the cap during the stamping step.

15. A tube sealing assembly for closing the open end of a tube during a forming operation comprising:

a cap having an inside and an outside, said cap defining first and second exit ports;

sealing means for sealing said inside of said cap to a tube;

static valve means for releasing liquid through said first port at static pressure from said inside to said outside; and high-pressure valve means for releasing liquid through said second port at a desired high pressure substantially above static pressure from said inside to said outside, whereby said static valve releases liquid during a capping step and said high-pressure valve release liquid during a stamping step.

16. The tube sealing assembly of claim 15 wherein said high-pressure valve means comprises spring washers.

17. A tube sealing assembly for closing the open end of a tube during a forming operation comprising:

a cap defining an exit port;

sealing means for sealing said cap to a tube;

first relief means for releasing liquid at a desired relief pressure from inside the tube through said exit port; and a second relief means for releasing liquid from inside the tube at about atmospheric pressure and holds liquid at a pressure greater than about atmospheric pressure, whereby said second relief means provides liquid relief during capping while the tube is submerged in liquid.

18. The tube sealing assembly of claim 17 wherein the second means for releasing liquid comprises a pressure relief valve having a spring, the spring expanding to force a piston to unseal a vent port at about atmospheric pressure, and compressing to cause the piston to seal the vent port at a pressure greater than about atmospheric pressure.

19. An assembly for sealing the open end of a tubular workpiece, said assembly comprising:

a body defining an exit port and adapted to fit over the end of the tubular workpiece, said body including sealing means for fluidly sealing said body to the workpiece;

first relief means for relieving a fluid within the workpiece through said exit port at a desired elevated pressure; and second relief means for relieving the fluid within the workpiece at atmospheric pressure, said second relief means including a deactuator means for closing said second relief means as said body is fitted over the workpiece.

20. A pressure-relief sealing unit for sealing a submerged liquid-filled tube comprising:

a cap defining an outlet port and an equalization port;

sealing means for sealing said cap to the tube;

means for preventing liquid flow through said outlet port when the internal pressure in the tube is below a given high pressure and allowing liquid flow through said outlet port when the internal pressure in the tube is above the given high pressure; and means for preventing fluid flow through said equalization port when the internal pressure in the tube is above a relatively low pressure and allowing fluid flow through said equalization port when the pressure is below the relatively low pressure to facilitate attachment of the cap to the submerged fluid-filled tube.

* * * * *

UNITED STATES PATENT AND TRADEMARK OFFICE

CERTIFICATE OF CORRECTION

PATENT NO. : 5,630,334

DATED : May 20, 1997

INVENTOR(S) : Stanley P. Ash

It is certified that error appears in the above-indentified patent and that said Letters Patent is hereby corrected as shown below:

In the Abstract, Line 1:
after "by" delete --tube is cold formed into a stamped member by--

Signed and Sealed this

Twenty-second Day of September, 1998

*Attest:*

*Attesting Officer*

BRUCE LEHMAN

*Commissioner of Patents and Trademarks*